US011692542B2

(12) United States Patent
Stark et al.

(10) Patent No.: US 11,692,542 B2
(45) Date of Patent: Jul. 4, 2023

(54) COMPRESSOR MAINTENANCE MONITORING AND ALERT SYSTEM

(71) Applicant: MAT Industries, LLC, Long Grove, IL (US)

(72) Inventors: Alan Stark, New Ulm, MN (US); Paul Thomas, Downers Grove, IL (US)

(73) Assignee: MAT INDUSTRIES, LLC, Long Grove, IL (US)

( * ) Notice: Subject to any disclaimer, the term of this patent is extended or adjusted under 35 U.S.C. 154(b) by 161 days.

(21) Appl. No.: 16/809,259

(22) Filed: Mar. 4, 2020

(65) Prior Publication Data

US 2020/0284252 A1 Sep. 10, 2020

Related U.S. Application Data

(60) Provisional application No. 62/813,525, filed on Mar. 4, 2019.

(51) Int. Cl.
*F04B 49/06* (2006.01)
*F04B 49/10* (2006.01)

(52) U.S. Cl.
CPC ..... *F04B 49/065* (2013.01); *F04B 49/10* (2013.01); *F04B 2207/701* (2013.01); *F05B 2260/80* (2013.01)

(58) Field of Classification Search
CPC .. F04B 49/065; F04B 49/10; F04B 2207/701; F04B 2260/80; F04B 2260/82; F04B 2260/821; G05B 23/0283; G05B 19/37351
See application file for complete search history.

(56) References Cited

U.S. PATENT DOCUMENTS

2002/0188422 A1* 12/2002 DeRose ..... F04D 27/02 702/182
2010/0228398 A1* 9/2010 Powers ..... F04B 49/065 700/282
2012/0230846 A1* 9/2012 Stephens ..... A62C 35/60 417/279
2018/0320684 A1* 11/2018 Rosca ..... F04D 13/06

FOREIGN PATENT DOCUMENTS

JP 2560715 Y2 * 1/1998

* cited by examiner

*Primary Examiner* — Philip E Stimpert
(74) *Attorney, Agent, or Firm* — Greer, Burns & Crain, Ltd

(57) ABSTRACT

A compressor maintenance monitoring and alert system for use with a compressor comprises a sensor unit including a housing, at least one vibration sensor and/or electrical impulse sensor, and a computer processor. The housing is constructed and arranged for being mounted or electrically coupled to the compressor. A processor of a mobile communication device receives compressor data transmitted by the sensor unit over a period of time, processes the received compressor data, determines if the received compressor data meets or exceeds scheduled maintenance tasks included in the look up tables, and displays required maintenance tasks on a display of the mobile communication device.

3 Claims, 17 Drawing Sheets

270

| Item | Hint | Electric | Gas | Belt | Direct |
|---|---|---|---|---|---|
| Unit Nickname | Give the unit a descriptive nichname to refer to such as Garage, Shop, etc. | x | x | x | x |
| Serial Number | Enter the serial number of the compressor for reference later. This is found on the unit nameplate. | x | x | x | x |
| Compressor Hours | This is the number of hours on the compressor. Enter an estimate if it is not a new machine. | x | x | x | x |
| Tank drain Alert | Turns on/off the Tank Drain Alert. Only turn off if you have an auto tank drain. | x | x | x | x |
| Tank Drain time (if alert turned on) | Set the time you want the alert for this compressor to show up on your phone. | x | x | x | x |
| Model Number | Select or enter the model number for your compressor. This is found on the nameplate. | x | x | x | x |
| Power Type | Select the type of power that drives the pump, electric or gas engine. | x | x | x | x |
| Drive Type | Select what drives the pump either a belt or direct. | x | x | x | x |
| Pair Device | Press this button to connect your phone to the device on the compressor. | x | x | x | x |
| Device Number | The device number of the hour meter pairing | x | x | x | x |
| Pump Oil hours | Enter the interval for maintaining the pump oil in hours | x | x | | |
| Pump Oil Months | Enter the interval for maintaining the pump oil in months | x | x | | |
| Pump Filter Hours | Enter the interval for maintaining the pump air filter in hours | x | x | | |
| Pump Filter Months | Enter the interval for maintaining the pump air filter in months | x | x | | |
| Motor HP | Enter the electric motor HP found on the nameplate of the motor. | x | | | |
| Kwh Cost$ | Enter the average Kwh Cost for your area. This can be found on your electric bill. | x | | | |
| Gas Engine oil Hours | Enter the interval for maintaining the gas engine oil in hours | | x | | |
| Gas Engine oil Months | Enter the interval for maintaining the gas engine oil in months | | x | | |
| Gas Engine Air Filter Hours | Enter the interval for maintaining the gas engine air filter in hours | | x | | |
| Gas Engine Air Filter Months | Enter the interval for maintaining the gas engine air filter in months | | x | | |
| Gas Engine Sediment Cup Hours | Enter the interval for maintaining the gas engine sediment cup in hours | | x | | |
| Gas Engine Sediment Cup Months | Enter the interval for maintaining the gas engine sediment cup in months | | x | | |
| Gas Engine Spark Plug Hours | Enter the interval for maintaining the gas engine spark plug in hours | | x | | |
| Gas Engine Spark Plug Months | Enter the interval for maintaining the gas engine spark plug in months | | x | | |
| Belt Hours | Enter the interval for maintaining the belt in hours | | | x | |

FIG. 14

COMPRESSOR MAINTENANCE MONITORING AND ALERT SYSTEM

PRIORITY CLAIM AND REFERENCE TO RELATED APPLICATION

This application claims 35 USC 119 priority to, and incorporates by reference, U.S. Provisional Patent Application Ser. No. 62/813,525, filed Mar. 4, 2019.

BACKGROUND

The present system generally relates to air compressors, and more specifically to a system for monitoring compressor operation for maintenance purposes.

Conventional air compressors, whether located in garages, auto body repair shops, commercial establishments or home garages or workshops require periodic maintenance. Such maintenance involves changing oil, filters, drive belts, draining the air tank or the like, as are well known in the art. Also, many compressor owners, particularly homeowners or non-commercial users, often are unfamiliar with the process and/or sources of required compressor repair parts.

Thus, there is a need for an enhanced system for identifying compressor maintenance needs. There is also a need for an improved compressor parts identification and sourcing system to facilitate the timely acquisition of needed compressor maintenance parts, especially by non-commercial users.

SUMMARY

The above-listed needs are met or exceeded by the present compressor maintenance monitoring and alert system, which monitors the number of hours that an air compressor is running, referred to herein as run hours, preferably through sensed vibrations and/or electrical impulses of the compressor. A sensor unit mounted to the compressor measures vibration and/or electrical impulses over time, stores vibration and/electrical impulse data, and periodically or on demand transmits the stored data to a mobile phone or equivalent computer via a wireless connection, such as Bluetooth or the like. A mobile phone application includes a directory of compressor model numbers, along with their maintenance schedules and the frequently used repair parts such as, but not restricted to lubricating oil, drive belts, filters and the like, as are well known in the art. A maintenance history or log for each compressor owned by the customer and connected to the sensor unit is also included in the application in display format.

Also available in a website associated with the application are Frequently Asked Questions related to compressor maintenance, contact information for designated parts suppliers as well as for customer service, and an ordering format to enable customers to easily order replacement parts, once those parts are identified, or links thereto. Other features of the application include service center location information, and an Alert function, where visual and/or audible alerts are displayed or generated of specific maintenance tasks that are required, based on the sensed compressor hours of operation transmitted by the run time. Alerts include, but are not limited to Pump Oil Change, Air Filter, Battery Life, Belt, Pump Filter Change, and Tank Drain. Multiple compressors are operable and/or are monitored by a single application.

More specifically, example embodiments of the invention provide, among other things, a compressor maintenance monitoring and alert system for use with a compressor, comprising: a sensor unit including a housing, at least one vibration sensor and/or electrical impulse sensor, and a computer processor, the computer processor having a vibration and/or electrical impulse sensor module, a compressor data storage module and a transmitter module, said housing being constructed and arranged for being mounted and/or electrically coupled to the compressor; a mobile communication device processor; and executable instructions stored on a non-transitory medium that when executed by the mobile communication device processor, cause the processor to: receive the compressor data transmitted by said transmitter module of the sensor unit over a period of time; process the received compressor data, including making a comparison of the compressor data with stored look up tables of compressor maintenance schedules; determining if the received compressor data meets or exceeds scheduled maintenance tasks included in the look up tables; and displaying required maintenance tasks on a display of the mobile communication device. In addition to any of the above features in this paragraph, alone or in combination, in an example embodiment the sensor unit may be constructed and arranged for measuring and storing vibrations and/or electrical impulses generated by the compressor over time, representing working hours of the compressor. In addition to any of the above features in this paragraph, alone or in combination, in an example embodiment the sensor unit may be constructed and arranged for either periodically or on demand transmitting sensed compressor data to the mobile communication device processor. In addition to any of the above features in this paragraph, alone or in combination, in an example embodiment the executed instructions stored on said mobile communication device include look-up tables of maintenance schedules of known compressor models. In addition to any of the above features in this paragraph, alone or in combination, in an example embodiment the displaying of the required maintenance tasks on the mobile communications device may include at least one of visual and audible alerts.

Example methods for operation of the monitoring and alert system, the sensor unit, and the mobile communication device processor are also provided. Further, an example apparatus for monitoring a compressor using a mobile communication device comprises: a processor of the mobile communication device; and executed instructions stored on a non-transitory medium that when executed by the processor cause the processor to perform methods according to any of the embodiments set forth herein.

BRIEF DESCRIPTION OF THE DRAWINGS

FIG. 14 is a list of example Field rules for the present application on the mobile communication device;

DETAILED DESCRIPTION

Figure 1:
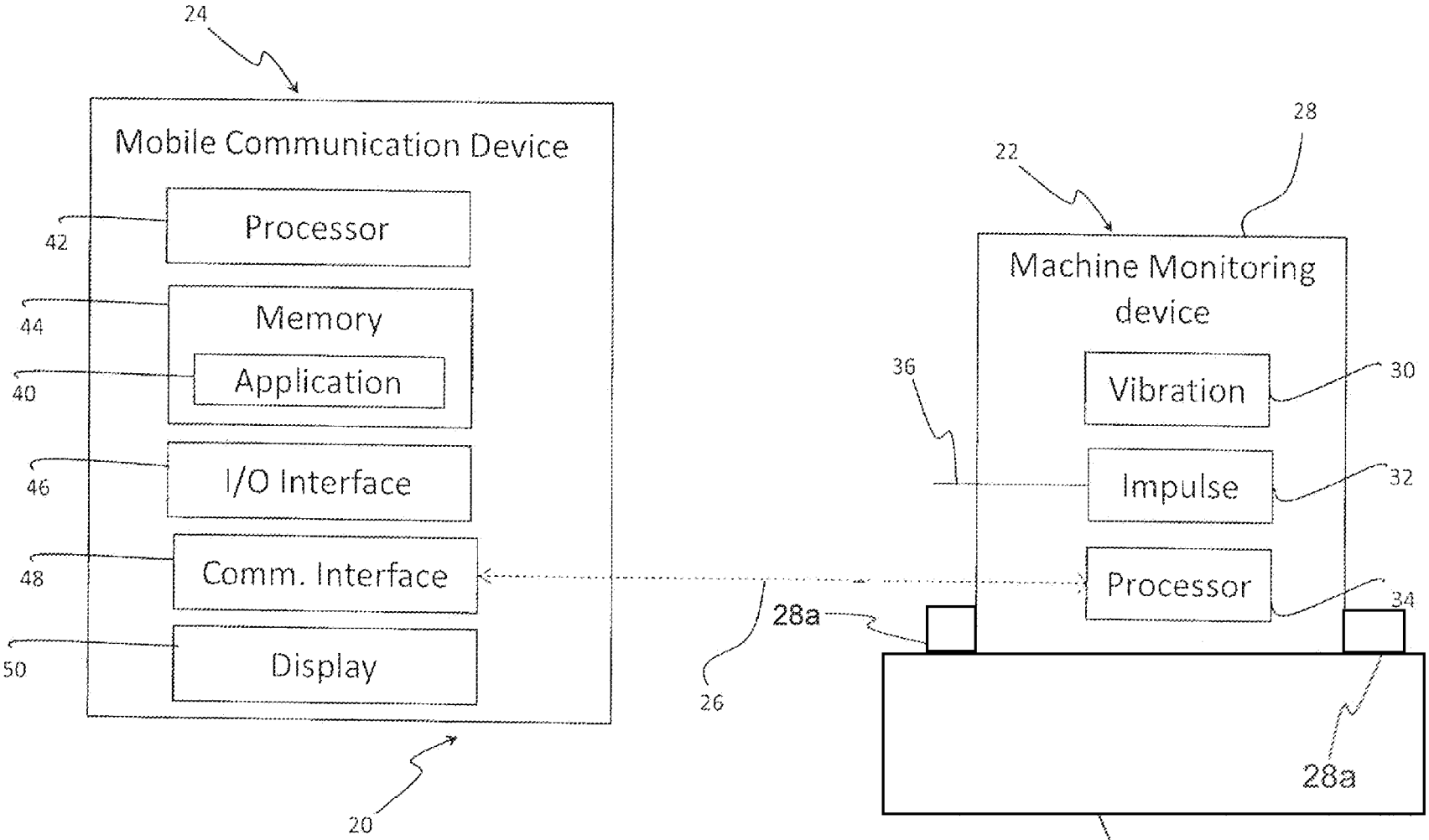
FIG. 1 is a schematic of an example system operation.

Referring now to the drawings, FIG. 1 shows an example compressor maintenance monitoring and alert system and operation thereof 20 according to an embodiment of the invention. The example system 20 includes a sensor unit embodied in a machine monitoring device 22, which is configured and disposed for wireless communication with a mobile communication device 24.

The sensor unit 22 is preferably constructed and arranged for measuring and (preferably) storing vibrations and/or electrical impulses generated by the compressor over time, e.g., one or more periods of time, as sensed compressor data. Such time can include, for instance, working time (e.g., working hours or other time increments) of the compressor. Further, the sensor unit 22 is preferably constructed and arranged for either periodically or on demand (e.g., from the mobile communication device) transmitting the sensed (and preferably stored) compressor data to the mobile communication device 24 via a wireless communication link 26, e.g., along one or more wireless communication channels.

The example sensor unit 22 preferably includes a housing 28, a vibration sensor 30 and/or an electrical impulse sensor 32, and a computer processor (processor) 34. The vibration sensor 30, electrical impulse sensor 32, and/or computer processor 34 may be disposed partially or completely within the housing 28. This housing 28 can be embodied in a housing provided for the vibration sensor 30, electrical impulse sensor 32, and/or for the computer processor 34 itself, or a separate housing within which the vibration sensor, electrical impulse sensor, and/or the computer processor is partially or completely disposed. The housing 28 is preferably configured and disposed for being mounted to a compressor 29.

For example, the housing 28 may be a casing or container (e.g., a box) that may be, but need not be, partially or completely enclosed, having one or more outer surfaces that can be mounted in any suitable way to the compressor using means for fastening 28*a*. Such mounting may be either directly to the compressor or indirectly, such as to an intermediate surface coupled to the compressor that receives transmitted vibrations from the compressor. The housing material should be selected to be suitable for transmitting vibrations from the compressor (when the sensor unit 22 is used to sense vibrations), and preferably for protecting any components (such as the vibration sensor 30, electrical impulse sensor 32, or computer processor 34) contained therein. Exemplary housing materials are plastic, metal or the like.

For sensing vibrations, for instance, mounting or means for fastening 28*a* may include, for instance, fastening, adhering, clamping, or any other method that allows the vibration sensor 30 to receive transmitted vibrations from the compressor. For sensing electrical impulses, the housing 28 may be fastened, adhered, clamped, etc., to the compressor or another surface, and a lead wire 36 coupled to the electrical impulse sensor 32 may extend therefrom and from the housing. This lead wire 36 may be electrically coupled to a source of electrical impulses, e.g., by being disposed (e.g., wrapped) around a spark plug wire of a gas-driven unit, to receive the electrical impulses and transmit them to the electrical impulse sensor 32.

The shape of the outer surface can vary depending on the particular configuration of the housing 28 and the type of mounting, which itself can vary depending on the configuration of the compressor to which the sensor unit 22 is mounted (for sensing vibrations and/or for sensing electrical impulses) or for the configuration of another mounting surface (if only sensing electrical impulses). For example, a box-shaped housing can provide one or more flat surfaces that can be selectively mounted to an abutting flat surface of the compressor or other surface, or a housing having a projected outer surface can be fastened or clamped to a compressor or intermediate surface, or other surface.

The vibration sensor 30, which receives vibrations from the compressor and generates one or more signals in response, can be separate from the computer processor 34 and connected via suitable connections (e.g., cabling or wiring, wireless, etc.) (not shown) or integrated with the computer processor (e.g., if the computer processor is part of a system-on-a-chip, includes vibration-sensing MEMS devices, etc.). Nonlimiting example vibration sensors include accelerometers (piezoelectric, piezoresistive, capacitive, etc.), strain gauges, laser or other displacement sensors, acoustic pressure sensors, other transducers, etc. One or more filters, analog-to-digital converters, signal conditioners, etc., may be used to process signals received from the vibration sensors, as will be appreciated by those of ordinary skill in the art.

The electrical impulse sensor 32, which receives electrical impulse signals from the compressor and generates one or more signals in response, can similarly be separate from the computer processor 34 and connected via suitable connections (e.g., cabling or wiring, wireless, etc.) (not shown) or integrated with the computer processor. Nonlimiting example electrical impulse sensors include any suitable electrical, magnetic, or optical transducer or sensor, sensor chip having one or more inputs (e.g., pins), etc., and may be analog or digital. The lead wire 36 can provide all or a portion of the electrical impulse sensor in some embodiments. The impulse signal may be processed, conditioned, and/or filtered if desired before entering the processor 34.

The computer processor 34 preferably includes a vibration sensor module and/or an electrical impulse sensor module, a compressor data storage module, and a transmitter module (not shown). These modules can be provided by executable instructions embedded as hardware, firmware, software (stored on a non-transitory medium) that can be executed by the computer processor 34 to perform particular functions as will be described in more detail herein. The computer processor 34 can also include integrated or connected memory for use in performing functions, as will be appreciated by an artisan, and preferably for storing, at least temporarily, sensed and/or processed compressor data. A power supply, such as a battery, capacitor, or other supply, can be provided in the sensor unit 22 for powering components of the sensor unit.

The vibration sensor module interfaces and/or communicates with the vibration sensor 30 to process vibration signals generated from the vibration sensor to sense vibrations. Such processing can include digitizing, filtering, quantizing, thresholding, counting, storing, etc., and can include determining whether vibration is present, and if so possibly determining one or more characteristics of the vibration (amplitude, frequency, etc.). Similarly, the electrical impulse sensor module interfaces and/or communicates with the electrical impulse sensor 32 to process electrical impulse signals generated from the electrical impulse sensor. Such processing can include digitizing, filtering, quantizing, thresholding, counting, storing, etc., and can include determining whether generated electrical impulses are present, and if so possibly determining one or more characteristics of the impulses (amplitude, frequency, etc.).

The vibration sensor module and/or electrical impulse sensor module output compressor data based on this processing. It is also contemplated that all or a portion of this processing can additionally or alternatively be performed by the mobile communication device 24. In some embodiments, both the vibration sensor module 30 and the electrical impulse sensor module 32 are provided in the sensor chip 22, but one or the other, or a combination, is selectively used according to the desired result or operating environment.

Example compressor data is provided herein, but other compressor data can be provided as well. A particular nonlimiting example of compressor data that may be generated based on sensed vibrations and/or sensed electrical impulses and stored in the sensor unit is hours of run time for the compressor (e.g., run hours), although other run time measurements are also contemplated (e.g., minutes, seconds, days, etc.), and it will be appreciated that features disclosed herein described with reference to run hours are similarly applicable to other run time measurements, using suitable conversions as needed or desired between selected time measurements. The compressor data storage module stores the output compressor data in temporary storage (e.g., random access memory (RAM)), non-temporary storage (e.g., non-volatile memory), or a combination for use in further processing and/or transmitting to the mobile communication device 24.

The transmitter module interfaces and/or communicates with a wireless transmitter (not shown), such as a radio frequency transmitter, optical (laser, infrared, etc.) transmitter, or other transmitter, to wirelessly communicate the compressor data (and other data, if desired) to the mobile communication device via the wireless communication channel 26. The transmitter module, for instance, can process the output compressor data and/or the stored compressor data for wireless transmission by the wireless transmitter. Such processing can depend on the particular wireless format or protocol used for the transmission, such as but not limited to RF, Bluetooth, Wi-Fi, DSSS, etc. The wireless communication channel 26 may be in one direction (unidirectional) and/or bidirectional wireless communication can be provided, such as for updating the sensor unit 22, providing sensing instructions for the sensor unit, handshaking, requesting transmission of stored and/or generated compressor data (as a nonlimiting example, requesting transmission of stored hours of run time when the sensor unit and the mobile communication device are within range to receive, transmit, and/or exchange communication) to update total stored hours that are stored and tracked via the mobile communication device), acknowledging receipt of the transmitted compressor data, etc. via the mobile communication device 24.

The sensor unit 22, including the vibration sensor module and/or electrical impulse sensor module, compressor data storage module, and/or the transmitter module, may include a timer or clock function to process, store, and/or transmit vibration and/or electrical impulse signals over one or more particular periods of time. These periods of time can be stored in the sensor unit 22 and/or communicated to the sensor unit via the mobile communication device 24. Suitable clock operation will be appreciated by an artisan.

In an example operation of the sensor unit 22, the vibration sensor 30 receives, directly or indirectly, vibrations from the compressor to which the sensor unit is mounted resulting from operation of the compressor, and the vibration sensor in turn generates vibration signals. The vibration sensor module samples and processes these vibration signals either continuously or periodically, and either continually or over selected periods of time, to provide sensed compressor data.

Alternatively or additionally, the electrical impulse sensor 32 receives, directly or indirectly, electrical impulses from the compressor (e.g., from a spark plug for a gas unit) via the lead wire 36 or other suitable conductive path resulting from operation of the compressor, which provides, or can be processed to provide, electrical impulse signals. The impulse sensor module samples and processes these electrical impulse signals either continuously or periodically, and either continually or over selected periods of time, to provide sensed compressor data.

This compressor data, or a portion thereof, may be stored in temporary (e.g., RAM or other memory) or non-temporary (e.g., non-volatile) storage to provide stored sensed compressor data. Either continuously, periodically (at periods either predetermined, selected according to one or more criteria, or requested by the mobile communication device) or on demand (e.g., by the mobile communication device, such as when the mobile communication device is in range to receive wireless communications and, optionally, when the mobile communication device transmits a request to receive), the transmitter module interfaces with the wireless transmitter to wirelessly transmit all of a selected portion of the sensed compressor data over the wireless communication channel 26. If compressor data is stored in the sensor unit 22 on a basis such as total vibrations or electrical impulses, total hours of run time, or other running totals, it is contemplated that totals can be, but need not be, reset (e.g., to zero) after transmission, either automatically, in response to a command from the mobile communication device, at particular time intervals, etc. If the compressor data is not stored, it can be forwarded during run time.

It is also possible, though not required, for the sensor unit 22 to transmit at least one identifier for the sensor unit for associating the compressor data with a particular sensor unit, and thereby with the compressor mounted to the sensor unit. The sensor unit 22 in some embodiments can be, but need not be, configured to include a sleep mode, in which the sensor unit enters a low-power mode until receiving a vibration and/or electrical impulse signal (or multiple signals over a period of time) exceeding a predetermined threshold to awaken and begin processing the vibration and/or electrical impulse signals.

The mobile communication device 24 receives the compressor data transmitted by the transmitter module of the sensor unit 22 over one or more periods of time. "Periods"

may be equal in duration or of different durations, such as when the compressor data is transmitted on request.

The mobile communication device 24 is a processor-based portable device, such as but not limited to a smai tphone or tablet, having a mobile application (mobile app) 40 running thereon. The mobile communication device 24 includes a processor 42, a memory 44 in which the application 40 may be stored for use, an input/output interface 46, a communication interface 48, and a display 50. which can communicate via a bus (not shown). An example mobile communication device 24 used herein for executing an example mobile app 40 is a smartphone, tablet computer, or other so-called "smart" device, such as but not limited to IPHONE™ or IPAD™ by Apple, Inc., GALAXY™ devices by Samsung, or PIXEL™ by Google, Inc., though of course other mobile communication devices can be used. The memory 44 can include transitory (e.g., random access memory (RAM) and others) and/or non-transitory memory, and may have stored therein applications including example mobile apps 40 as disclosed herein, along with suitable application programming interfaces (API), middleware, kernels, operating system (OS), etc., as will be appreciated by those of ordinary skill in the art. The mobile app 40 may be stored in a non-transitory memory and/or a storage medium (computer-readable medium) for execution by the processor 42. The mobile communication device 24 preferably can communicate with the sensor unit 22, and optionally with other electronic devices either over a direct link (not shown), including the wireless communication channel 26, and/or via a network. Wireless communication can be via any suitable wireless communication protocol, including but not limited to those disclosed by example herein. As will be appreciated by those of ordinary skill in the art, the mobile app 40 can preferably be downloaded for installation and/or updates onto the mobile communication device 24 over the Internet, through an application store or "app store," directly through a storage device, pre-installed on the device, or in other ways.

Generally, the processor 42 of the mobile communication device 24 receives the compressor data transmitted by the transmitter module of the sensor unit 22 over a period of time, processes the received compressor data, and based on this processing determines and displays required ("required" can also include suggested) maintenance tasks, e.g., on the display 50. In some embodiments, the received compressor data is combined with (e.g., added to) previously received compressor data. For instance, the mobile communication device 24 could sync with the sensor unit 22 to receive new or updated compressor data, and combine this new or updated compressor data, e.g., new run hours, with previously stored run hours to provide totaled compressor data, e.g., a total number of run hours that have occurred during a particular interval (e.g., since a previous reset). In example embodiments, the processor 42 makes a comparison of the received compressor data (which in some embodiments can include totaled compressor data) in look up tables of compressor maintenance schedules, which are preferably stored on the mobile communication device 24 (but may be stored elsewhere, such as on a server or externally accessible device or system).

For instance, the mobile communication device 24 can search a portion of a look up table corresponding to the compressor (or suitable equivalent or comparable compressor, or one or more default compressors) for which vibration and/or electrical impulses is/are being sensed (which preferably is stored within the mobile communication device) to determine a number or range, such as a threshold number(s) or range(s), of compressor vibrations or electrical impulses, or combined value derived from one or both of vibrations or electrical impulses (either overall or over a particular period of time) for which scheduled maintenance tasks are required or recommended. This look-up table may include or be derived from, for instance, tables of maintenance schedules of known compressor models. The table may also include equivalent or similar compressors for which maintenance schedules are unknown, but are believed to be comparable. One or more default maintenance schedules can also be provided if desired.

The sensed (and possibly totaled) compressor data (e.g., run hours, total number of vibrations and/or electrical impulses, number of vibrations and/or electrical impulses over a period of time, number of vibrations and/or electrical impulses exceeding a particular amplitude and/or frequency, particular patterns of vibrations and/or electrical impulses, etc.) is compared to the determined number or range (e.g., threshold), either alone or for a particular time interval (e.g., days, weeks, months, etc.) to determine whether the sensed compressor data meets or exceeds the number correlated with scheduled maintenance tasks included in the look up tables. Comparison may be exact or approximate, may include averaged data or weighted average data from multiple thresholds, or may be based on other factors. The number of vibrations and/or electrical impulses, time, etc. may be converted to align with the threshold units as needed. A nonlimiting example vibration and/or electrical impulses number measure is run hours.

In a particular example method, a database of compressor models, identified at least by compressor model numbers, are stored in the mobile app 40 that can preload hour time intervals for triggering a notification of one or more maintenance items. This notification can optionally be based on hours of run time and calendar date, where the calendar date tracking is performed by the mobile app 40 and/or the operating system of the mobile communication device 24 (or in other embodiments by the sensor unit 22).

Based on this comparison and determination, the required maintenance tasks are displayed on the display 50 of the mobile communication device 24, or outputted to a display in communication with the mobile communication device, as notifications. In some embodiments, this display can be an alert or similar Displaying can include one or more of visual and/or audible alerts, vibrations, etc. The result of the comparison can also be stored and retained for later analysis, comparison, follow-up (e.g., subsequent reminders, integration with calendars, etc.), etc.

In example embodiments, such processing by the mobile communication device 24 is performed by the mobile app 40 (though alerts may be generated in combination with an operating system of the device, as explained below). The mobile app 40 preferably further includes an interactive user interface for receiving user inputs regarding the compressor and displaying one or more alerts.

Figure 2:
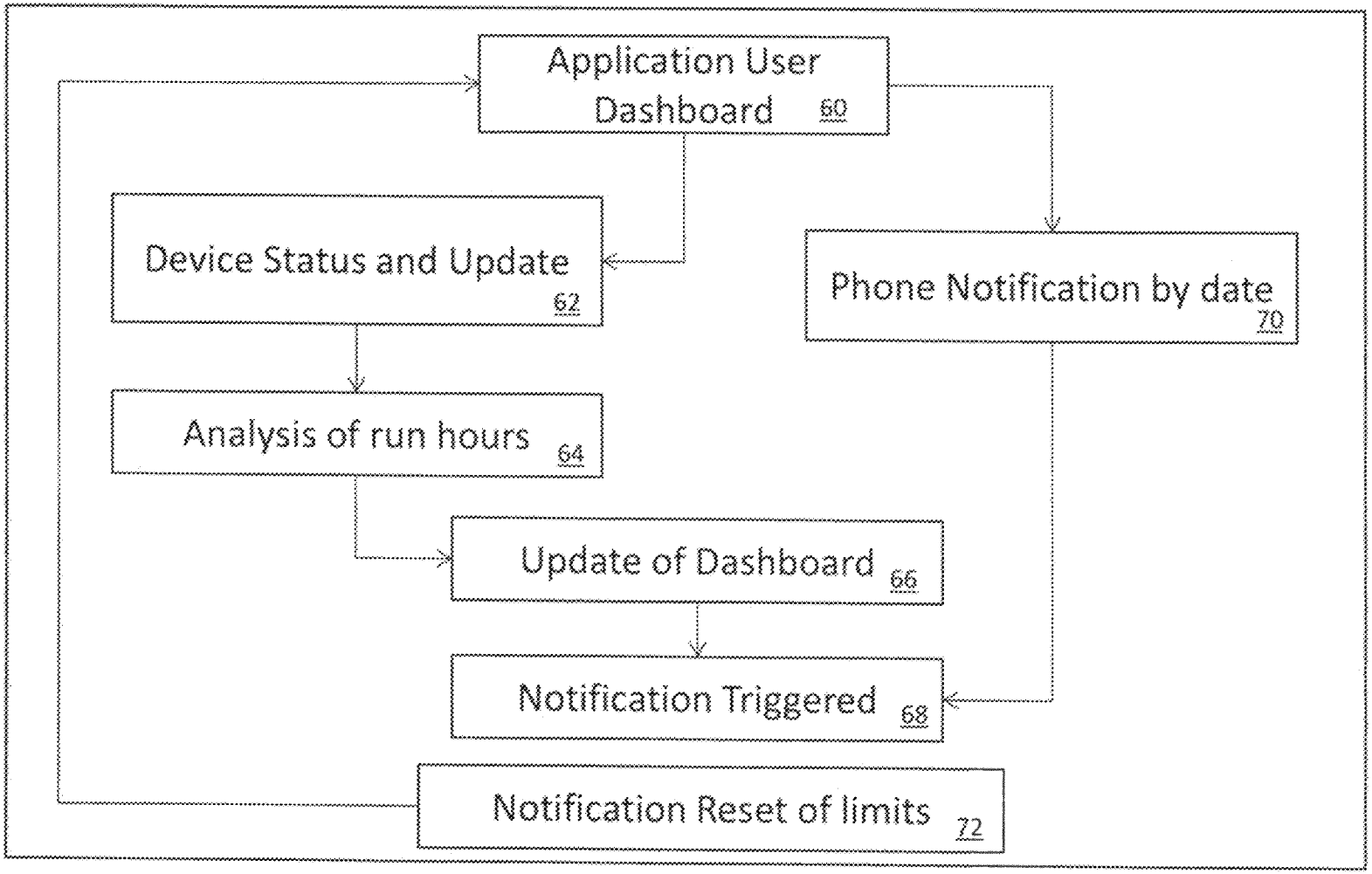
FIG. 2 is an operational flow chart of the present system.

FIG. 2 shows an example operational flow chart employing the mobile app 40. The mobile app 40 generates and/or iterates or updates an application user dashboard for a stored compressor 60. A vibration device status is checked 52, and any updates, such as new sensed compressor data, are received. The mobile app 40 analyzes the new (and possibly previous, as well, such as if the data is being combined or updated) sensed compressor data to analyze run hours for the compressor 64. The selected compressor can be input by the user or other device (including the vibration and/or electrical impulse sensing device in some embodiments), prestored, or determined in other ways. Based on the analysis results, the dashboard is updated 66, and any notifications (e.g., alerts) are triggered 68. Such notifications may also include notifications by date 70. After triggering a notification, the limits for the notification may be reset 72.

Figure 3:
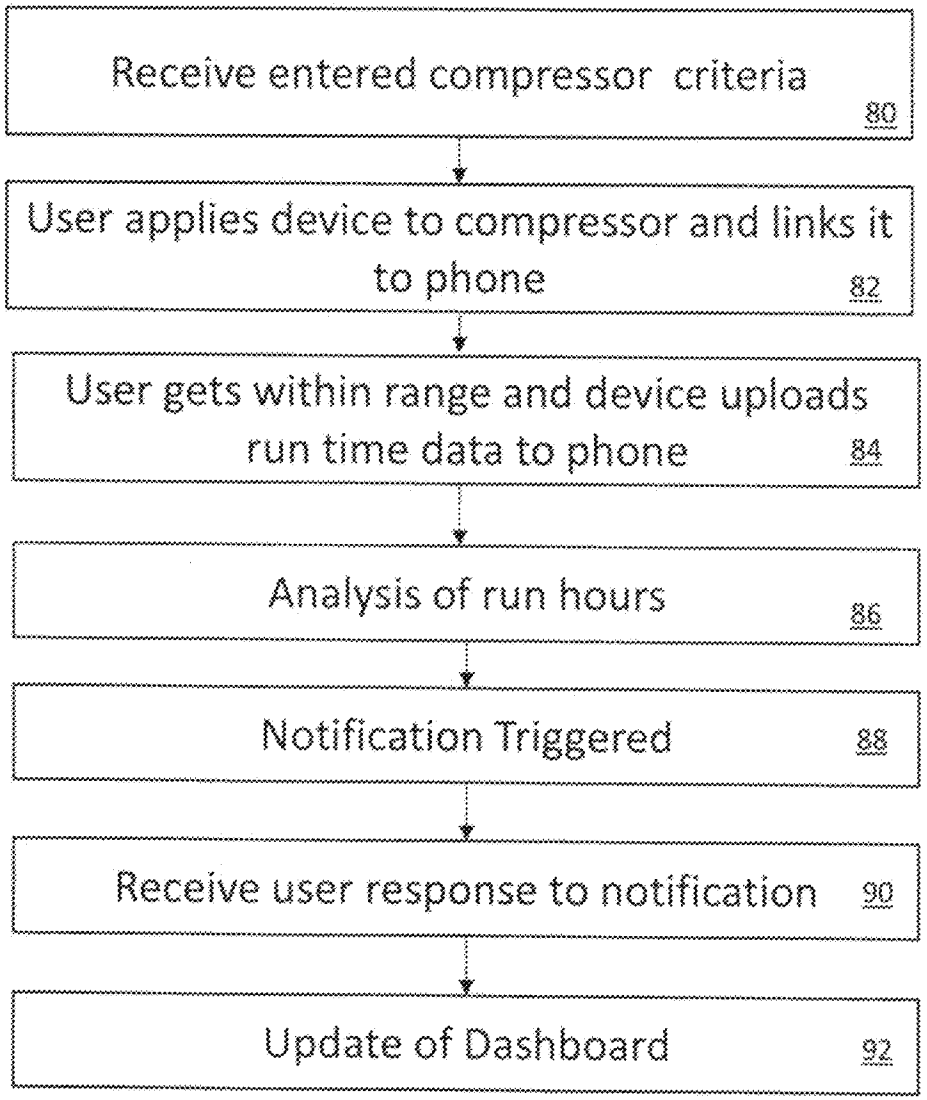
FIG. 3 is a schematic of user interaction with the system.

FIG. 3 shows an example method of operation of the mobile app 40 executed on a phone, including user interaction. The user enters compressor criteria into the mobile app 40 sufficient for the mobile app 40 to identify the particular compressor with respect to the stored look up tables, which criteria is received 80 by the mobile app 40. Previously stored compressors can be selected by the user, such as by displaying identifying information for one or more stored compressors and receiving a selection among them. Non-limiting example data fields that may be used for the compressor criteria and other example data fields are shown in FIG. 14.

To measure compressor vibration, the user applies 82 the vibration sensor device 30 or the electrical impulse sensor device 32 to the compressor, e.g., by mounting the housing 28 to a compressor surface or to another surface capable of transmitting the compressor vibrations and/or electrical impulses, and links the vibration sensor device and/or electrical impulse sensor device to the mobile communication device, e.g., by a Bluetooth pairing or other wireless pairing and/or by an assignment of the sensor device to one of the stored compressors in the mobile app. The user gets (e.g., moves) the vibration sensor device 30 (and/or the electrical impulse sensor device 32) and the mobile communication device within an operable range, and the vibration and/or electrical impulse sensor devices 30, 32 upload(s) 84 run time compressor data to the mobile communication device 24. This uploading 84 may be in response to a request from the mobile communication device 24, automatically triggered when the mobile communication device is in range, initiated after a timer, etc.

The mobile app 40 processes the uploaded compressor data to analyze run hours 86 or other vibration-based or electrical impulse based statistics for comparison to appropriate fields in the look-up table. Data may be filtered, modified (e.g., converted, quantized, thresholded, etc.) before, during, or after the analysis 86. As a result of the comparison and determination described above, a notification is triggered for display 88. The user can then respond to this notification via the user interface of the mobile app, which is received 90 by the mobile app 40. The dashboard is then updated 92.

Figure 4:
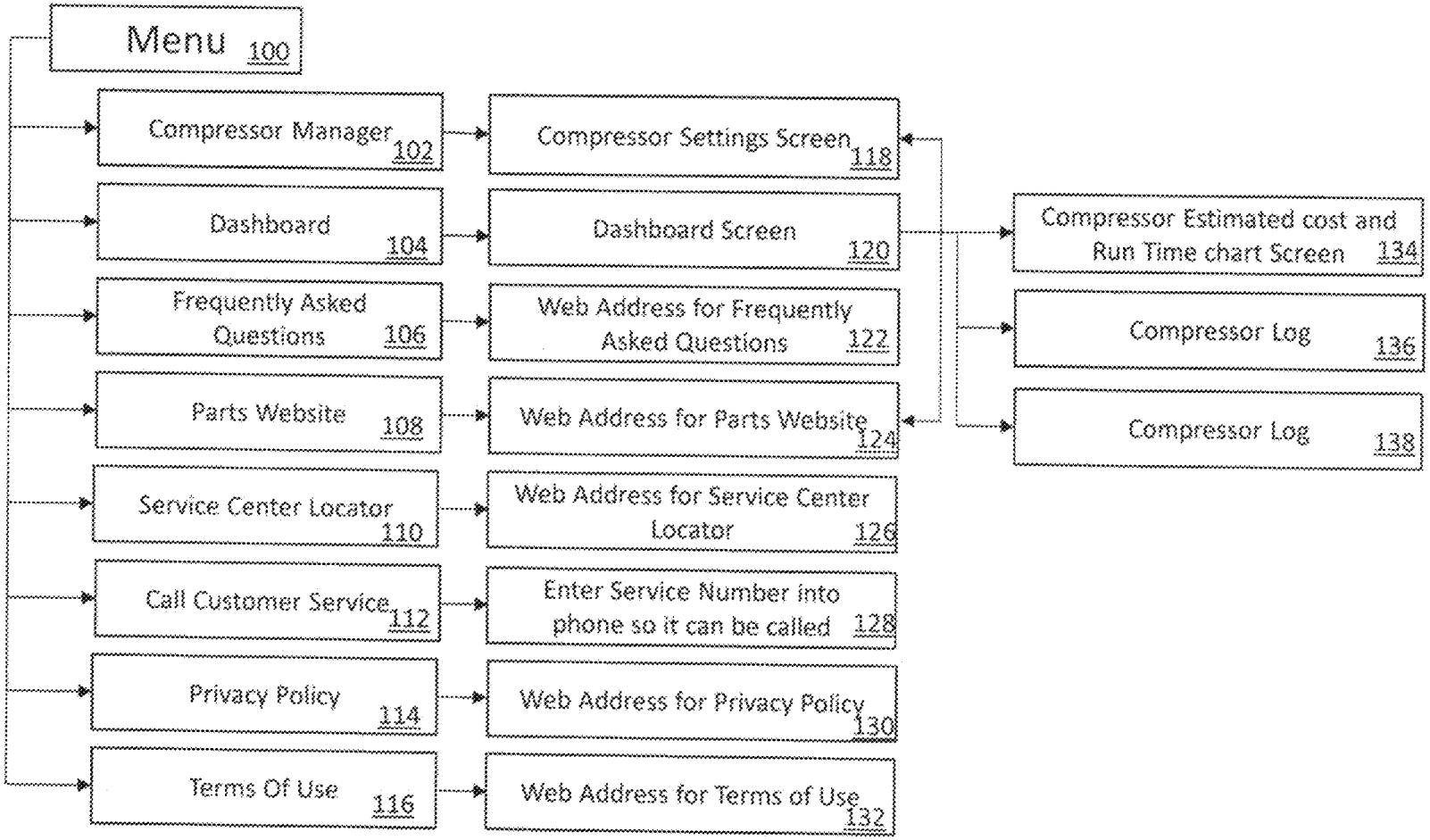
FIG. 4 is a schematic of operational features of the mobile communication device application, illustrating an example flow.

FIG. 4 shows operational features, structure, and navigation of an example mobile communication device application. Each of the blocks shown in FIG. 4 in an example embodiment represents a screen or page on a display of a mobile communication device, but blocks may be divided into multiple screens or pages and/or multiple blocks may be consolidated into single screens or pages. Screens or pages may be scrolled, enlarged, embedded, etc. as will be appreciated by an artisan. Screens may be linked using conventional links (e.g. hyperlinks, page navigational tools, etc.)

From a menu page 100, pages/screens for a compressor manager 102, dashboard 104, frequently asked questions (FAQ) 106, parts website 108, service center locator 110, customer service 112, privacy policy 114, and terms of use 116 are accessible. From these initial pages/screens, the compressor manager 102 flows to a compressor settings screen 118, the dashboard 104 flows to a dashboard screen 120, the FAQ 106 flows to a web address for FAQ 122, the parts website 108 flows to a web address for parts 124, the service center locator 110 flows to a web address for service center 126, the customer service 112 flows into an interface for entering a service number 128, the privacy policy 114 flows into a web address for the privacy policy 130, and the terms of use 116 flows into a web address for terms of use 132. From the dashboard screen 120, the user can navigate to a compressor estimated cost and run time chart screen 134, and one or more compressor logs 136, 138. One or more of these screens could be provided by one or more web pages external to the mobile app, or by links to such external web pages.

Figure 5:
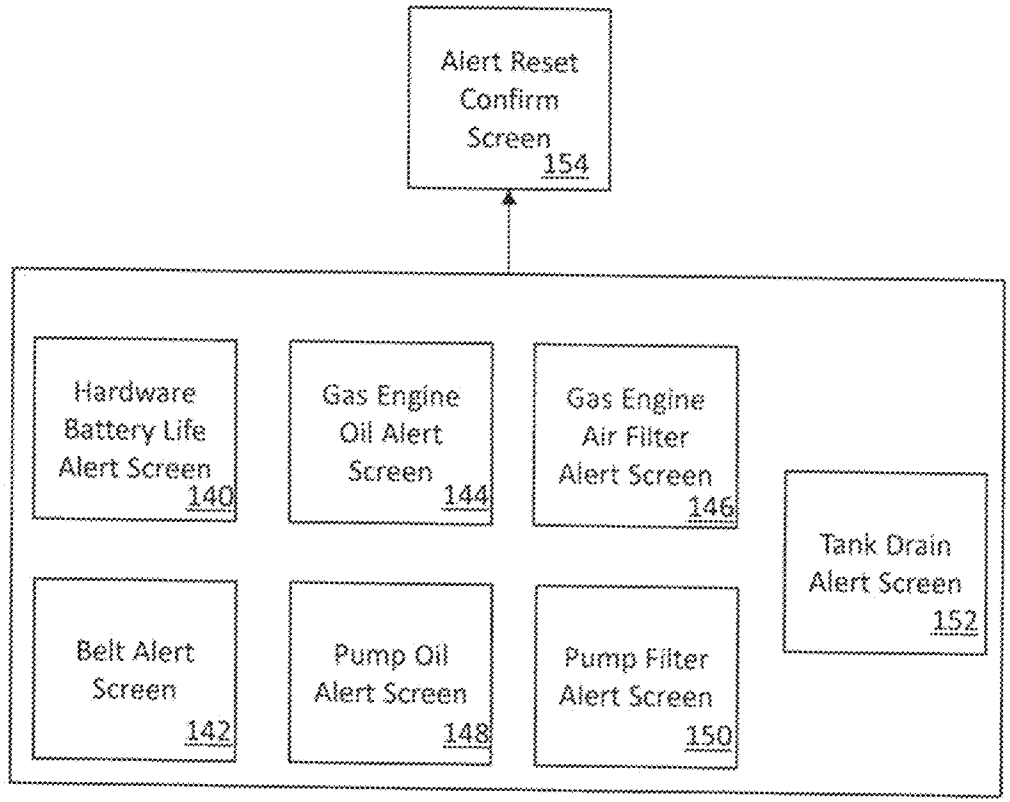
FIG. 5 is a schematic of example alert screen features.

Referring now to FIG. 5, alerts, e.g., alert screens, popups, banners, audible alerts, etc., generated by the example mobile app 40 (alone or in cooperation with the operating system of the mobile communication device 24) may be generated in response to a comparison of particular example maintenance tasks that may be included in the look up table. Such alerts include, but are not limited to: a hardware battery life alert screen 140; a belt alarm screen 142; a gas engine oil alert screen 144; a gas engine air filter alert screen 146; a pump oil alert screen 148; a pump filter alert screen 150; and a tank drain alert screen 152. Each of these alerts can be associated with criteria (e.g., a vibration and/or electrical impulse number or amount threshold) that is compared to received and analyzed vibration and/or electrical impulse sensor data, e.g., run hours. If an alert is generated, and the alert is reset either manually by the user or automatically by the mobile app the mobile app 40 can display an alert reset confirmation screen 154.

In addition to being displayed on the display 50 of the mobile communication device 24, alerts and/or other results of the processing may also be stored (e.g., in the memory 44 or storage of the mobile communication device or an external device), printed, communicated to an external device, e.g., via email, text, etc., or uploaded to a network (e.g., the Internet, WAN, LAN, etc.).

For illustrating an example operation of the mobile app user interface, FIGS. 6-13 and 15-17 show example screenshots displayed by the mobile communication device 24, such as but not limited to a mobile phone, e.g., IPHONE™ by Apple, Inc., running an example mobile app in a mobile operating system, e.g., iOS, or a mobile phone running an example mobile app in ANDROID™. As shown by example in FIG. 6, the mobile app 40 displays an initial page 200; that is, an app opening screen, on the mobile communication device display 50. In an example mobile app 40, the initial page 200 is displayed if no compressors have been added by the user and stored by the mobile app, for instance when the user first acquires (e.g., purchases) and launches the app. If one or more compressors have been added and stored, preferably the dashboard page 104 (see FIG. 8) is displayed on app launch. Alternatively, the initial page 200 can be displayed initially or otherwise navigated to after adding compressors.

Figure 6:
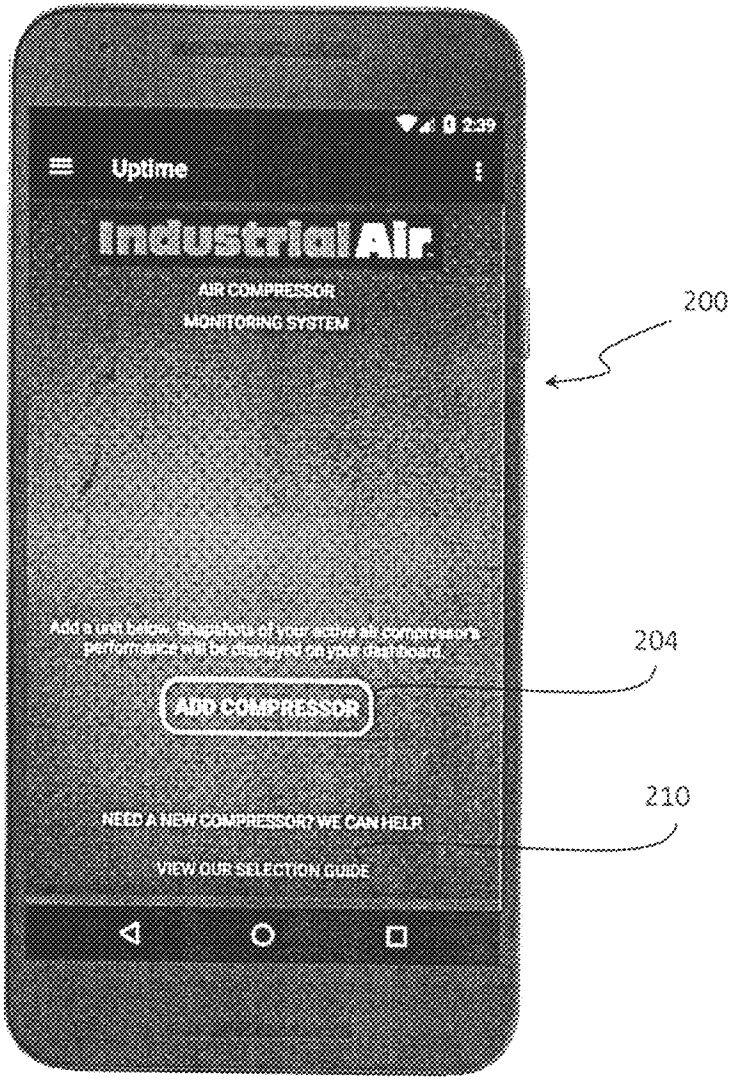
FIG. 6 is a view of a mobile communication device displaying an initial page of a system display, before compressors to be monitored have been added.
Figure 11:
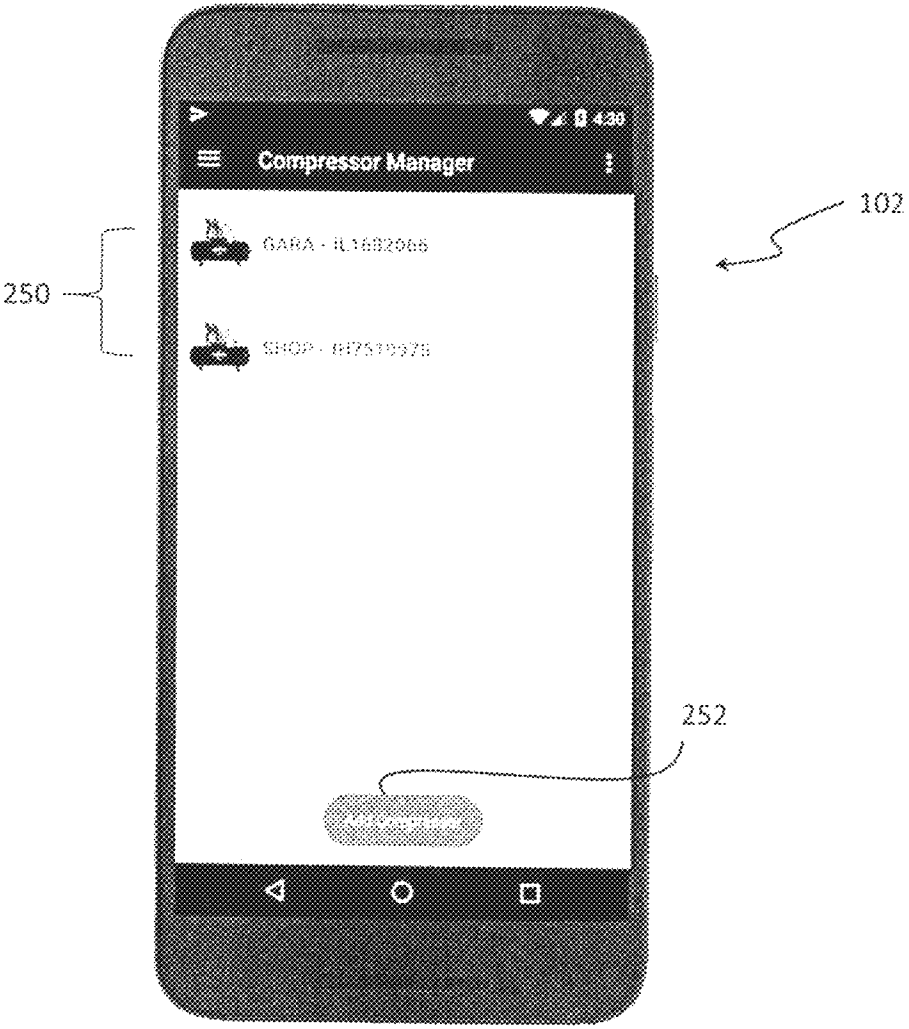
FIG. 11 is a view of an initial compressor monitor display on the mobile communication device, showing a list of compressors for selectively monitoring.

The example initial page 200 in FIG. 6 is similar in function to a splash screen. The initial page 200 includes links 204 or other navigation tools to setting up (e.g., adding) a compressor to be monitored for vibration via the compressor manager page 102 (FIG. 11). Another link 210 may be provided to a document assisting with selecting a compressor. The initial page 200 may be used to guide a user in setting up a compressor.

Figure 7:
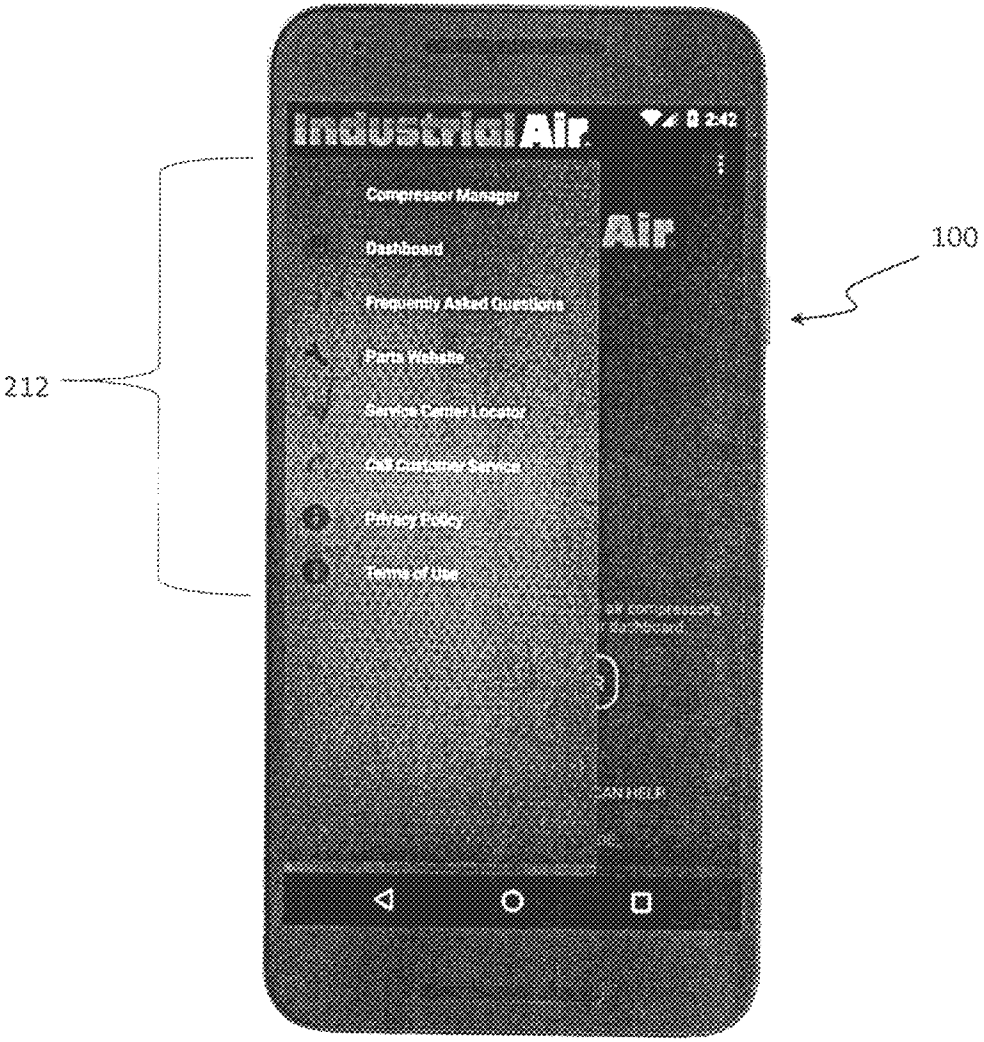
FIG. 7 is a view of the menu screen on the mobile communication device.

FIG. 7 shows an example main menu page 100. The main menu page 100 includes links 212 to each of: the compressor manager page 102; the dashboard page 104, which the status of each compressor; the FAQ page 106, with links to the external web page 122 with documents for assistance; the parts website 108, with links to the web page for parts 124; the service center locator 110, with links to the web page for service centers 126; the call customer service page 112, which brings up a customer service number 128 ready to call, and can provide an interface for entering the service number; the privacy policy page 114, with links to an external web page 139; and terms of use 116, with links to an external web page 132.

Figure 8:
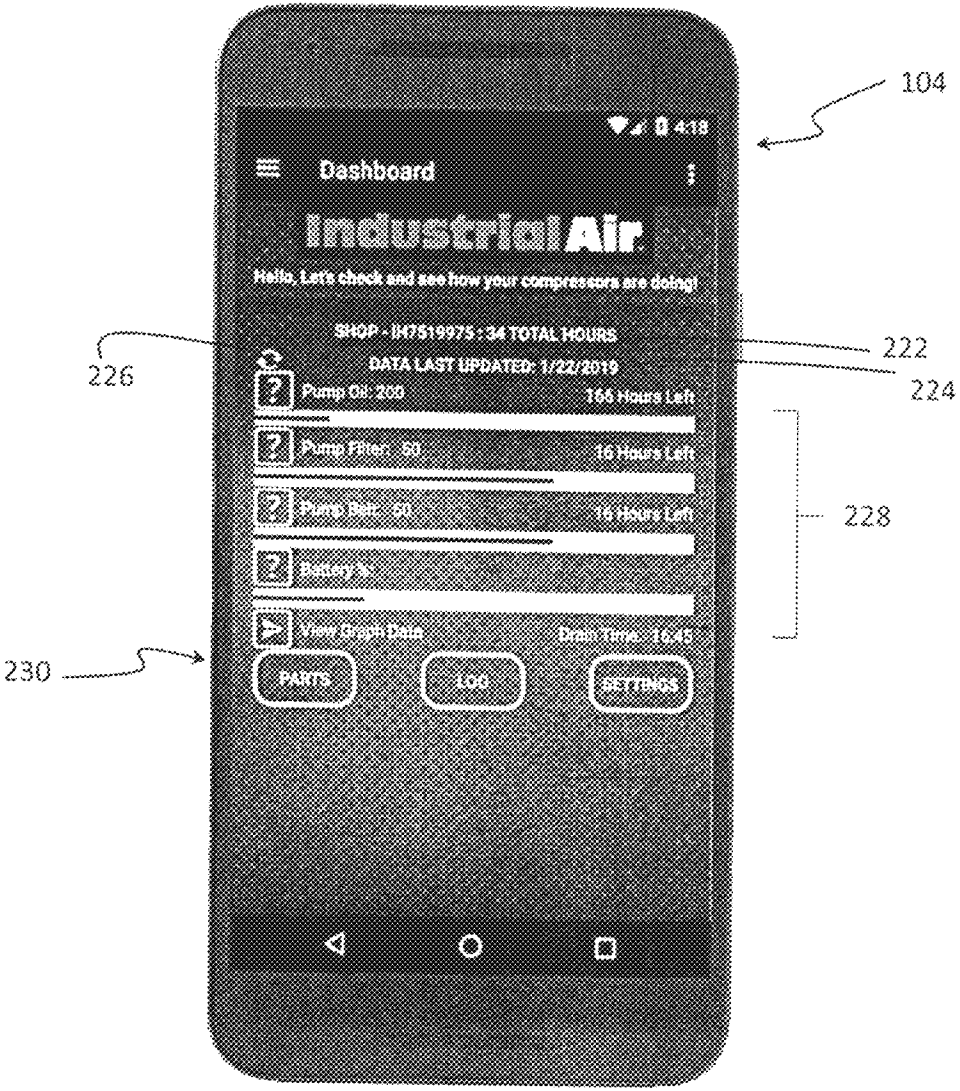
FIG. 8 is a view of a dashboard display on the mobile communication device.

FIG. 8 shows the example dashboard page 104, which, as stated above, can be displayed at launch of the mobile app 40 when one or more compressors have been entered. If more than one compressor is entered and stored, the dashboard page 104 may be scrolled, hyperlinked within the page or to another page, etc.

The dashboard page 104 shows a status of each compressor in one or more charts. The example dashboard page 104 shows titles 222 for a particular compressor including Compressor Name; Model Number; and Total Hours to identify the compressor. An indicator 224 of the most recent date the app 40 was updated with data from the sensor unit 22 can be provided. An icon 226 can be provided for allowing a user to manually update the received data. This icon 226 or another icon can indicate whether or not the app 40 is connected to the sensor unit 22 (e.g., green when connected, red when not).

Graphs 228 display monitoring results (in this example, vibration monitoring results), e.g., a bar or line graph showing a portion of total run hours between particular required maintenance tasks, for monitored tasks such as pump oil, pump filter, pump belt, gas engine items, etc. to provide summary information at a quick glance. A bar or line graph can also be provided for monitoring the battery strength of the vibration sensor unit. Bars or graphs can provide additional indicators of capacity remaining, use, etc. (e.g., a green bar until the battery voltage is under a predetermined amount, then a red bar until a new time interval has been reset).

Figure 9:
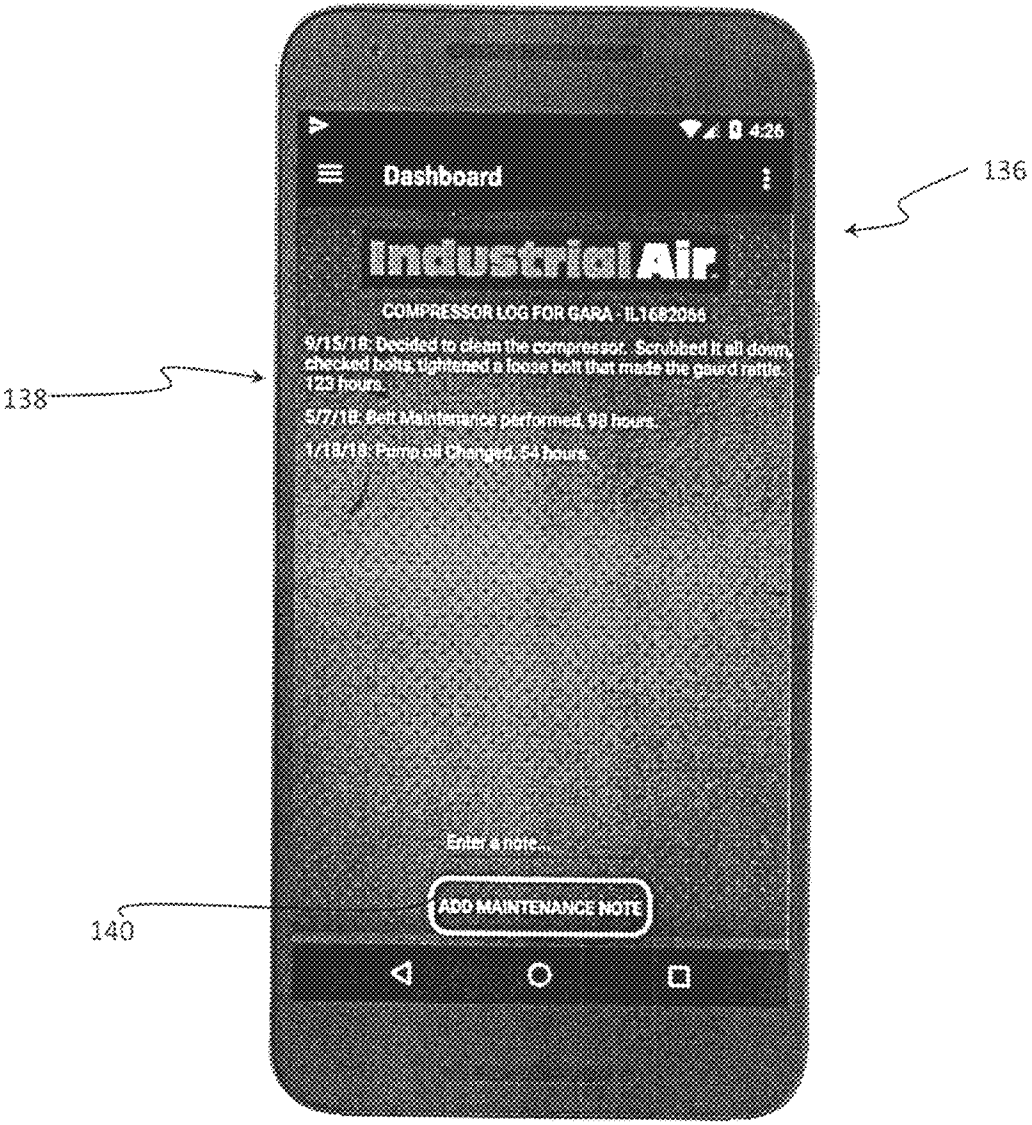
FIG. 9 is a view of an example displayed maintenance log for the compressor.

Links 230 to other pages, such as the maintenance log page 136, 138, manage compressor settings page 118, or a view graph data page 232 (FIG. 10), can be provided. FIG. 9 shows an example maintenance log page 136. The maintenance log page 136 includes details 138 stored in the maintenance log for the selected compressor. Additional notes can be provided by selecting an icon 140 and entering a new note.

Figure 10:
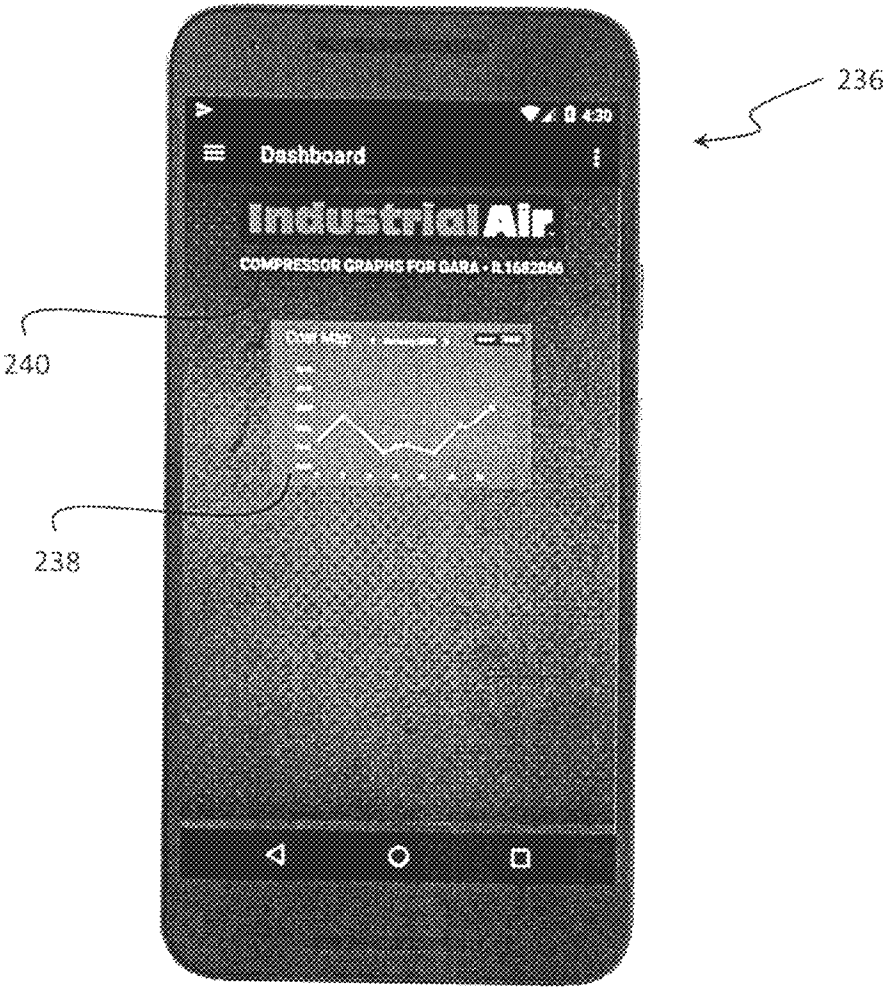
FIG. 10 is a view of a display screen showing calculated power used based on Kwh from setting and horsepower (HP) of the compressor, with an electric option selected.

FIG. 10 shows an example individual graph data page 236 depicting a cost estimate. Individual graphs, charts, tables, or other organized data groups may be displayed on their own page for review and interaction, or multiple data may be shown on the same page. In the data page 236, a cost estimate chart 238 is optionally provided for required or suggested maintenance tasks. The example data page 236 shows identifying information 240 for a particular compressor. Preferably, the user can interact with the chart 238 to, for instance, change the unit of time displayed in chart (day, week, month, year, etc.), and/or to zoom in or out of the chart. An example cost estimate shown in the cost estimate chart 238 links to calculated power used based on Kwh from setting and HP of the compressor (where the compressor is indicated to be electric). A chart for compressor run times can also be provided. For charts showing estimated costs such as chart 238, a displayed message indicating that the costs are merely estimates can also be provided.

FIG. 11 shows an example compressor manager page 102 including a list 250 with two stored compressors (more or fewer are possible). This allows a user to quickly review the list 250 of compressors for monitoring, and to add, edit, or remove compressors. Each compressor added is shown, though this is not required. Each compressor monitored may be associated with a separate piece of hardware (e.g., a sensor unit) mounted to receive signals (electrical impulse and/or vibration signals) for compressor data. For each stored compressor, the compressor name, model number, and a picture of the compressor (or, say, a default, such as a generic icon) may be displayed in the list 250. A user selection icon 252 may be provided for adding one or more compressors. Receiving a selection from the displayed list 250, e.g., by receiving a selection when the user clicks on the listed item in the list, brings the user to the compressor settings screen 118 showing the settings for that compressor.

Figure 12:
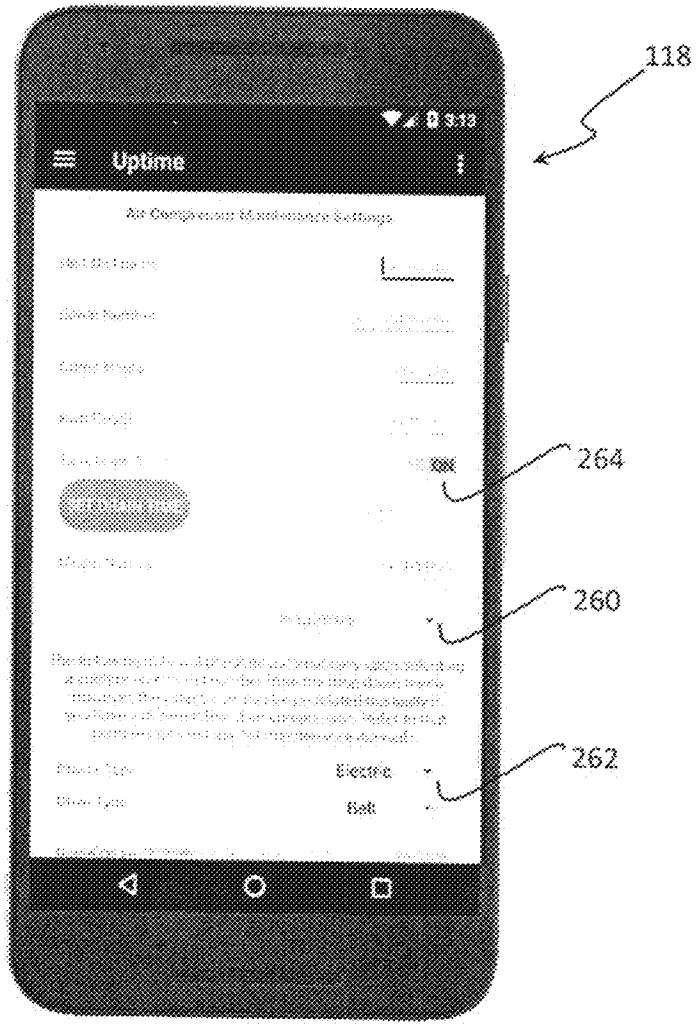
FIG. 12 is a view of a compressor manager page on the mobile communication device for a selected compressor.
Figure 13:
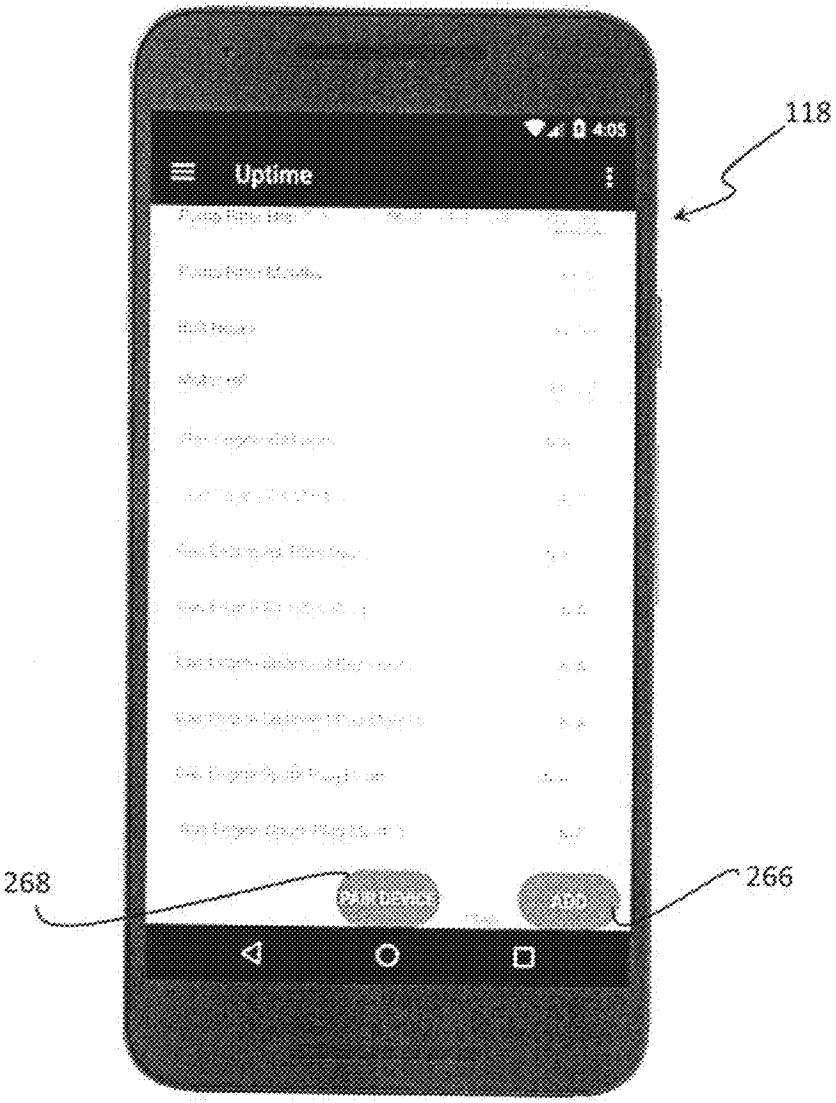
FIG. 13 is a view of the display of an air compressor maintenance settings page for the compressor manager on the mobile communication device.

FIGS. 12-13 show an example compressor settings screen 118 in two scrolled positions. The compressor settings screen 118 allows a user to input data for each stored compressor in selectable fields. Dropdowns or other controls 260 can be provided to autofill data from a database of compressor information if available. Tools (e.g., dropdown menus) 262 can be provided for manually entering compressor information as well. Run hours for the entered compressor can default to zero, but this may be overridable by a user if needed (for instance, for an older compressor). A popup can be provided for confirming the override. Other controls can include a tank drain alert slide (off/on) 264, delete (e.g., red) button (not shown where, as in screen 118, a new compressor is being added), icons, widgets, or other tools. An "Add" icon or other tool 266 can be provided for adding the input compressor with associated data to the list of stored compressors for the mobile app.

Each compressor monitored will employ a separate vibration sensor unit mounted to the respective compressor. Preferably, the manage compressor page also provides an icon or other selectable tool 268 for pairing (or re-pairing) a new vibration or electrical impulse sensor (e.g., sensor unit 22) with the mobile app 40 for use with a new or different compressor. In response, the identified vibration and/or electrical impulse sensor (or sensor unit 22) is associated with the stored compressor by the mobile app 40, such as by number or name. This information is transmitted independently of the data.

FIG. 14 shows example fields 270 for a database of stored and/or available compressors, with hints that may be provided to the user for assistance in locating and entering the information. If during configuration using the manage compressor page 118 a field is not filled in, the mobile app 40 may check and warn the user. Preferably, if a field is not used (e.g., pump oil for a particular direct compressor), it can be hidden once it is determined that it is not to be used (such as after a direct compressor type is selected) to avoid incorrect entries or user confusion. Notifications (e.g., alerts) can be re-evaluated and/or triggered by the mobile app 40 based on any changes to the compressor settings.

Figure 15:
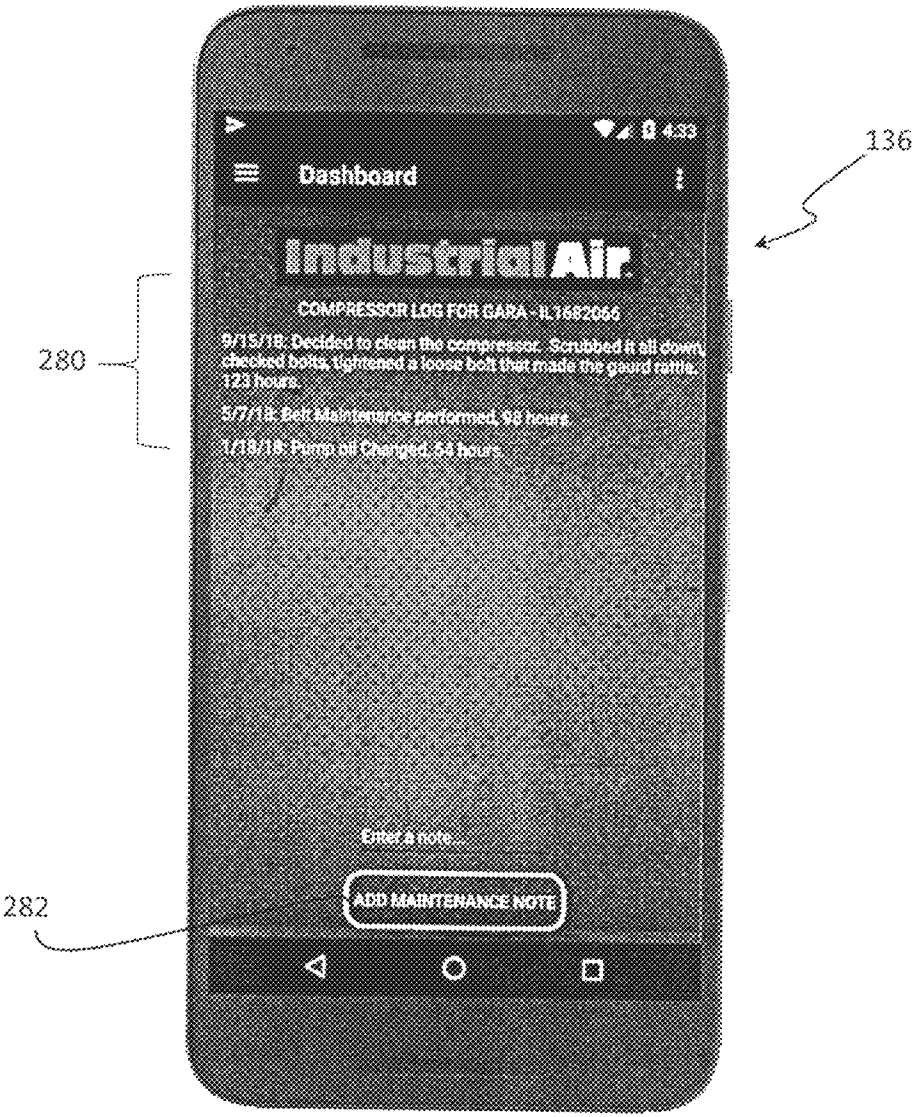
FIG. 15 is a view of the Maintenance Log of the present application on the mobile communication device.

FIG. 15 shows an example maintenance log page 136, which can be used to record, for instance, each reset of a notification (with some exceptions that may be provided, such as for tank drains) for each compressor after required or suggested maintenance is performed. Displayed data 280 can be shown on the maintenance log page 136. A tool or other selectable icon 282 can be provided for adding a maintenance note. Example maintenance data recorded for the reset includes compressor name, model serial number; the maintenance date, item done, and hours on compressor when performed; and other data (e.g., a line item) entered by the user, for instance, in a form field or edit box.

As indicated above, preferably the FAQ, parts website, service center locator, call customer service page, privacy policy page, and terms of use are provided by presented links to one or more external website pages. Preferably, these external pages are launched (brought up) optionally either inside or outside the mobile app and navigated inside or outside the app using suitable interface methods that will be apparent to an artisan.

Figure 16:
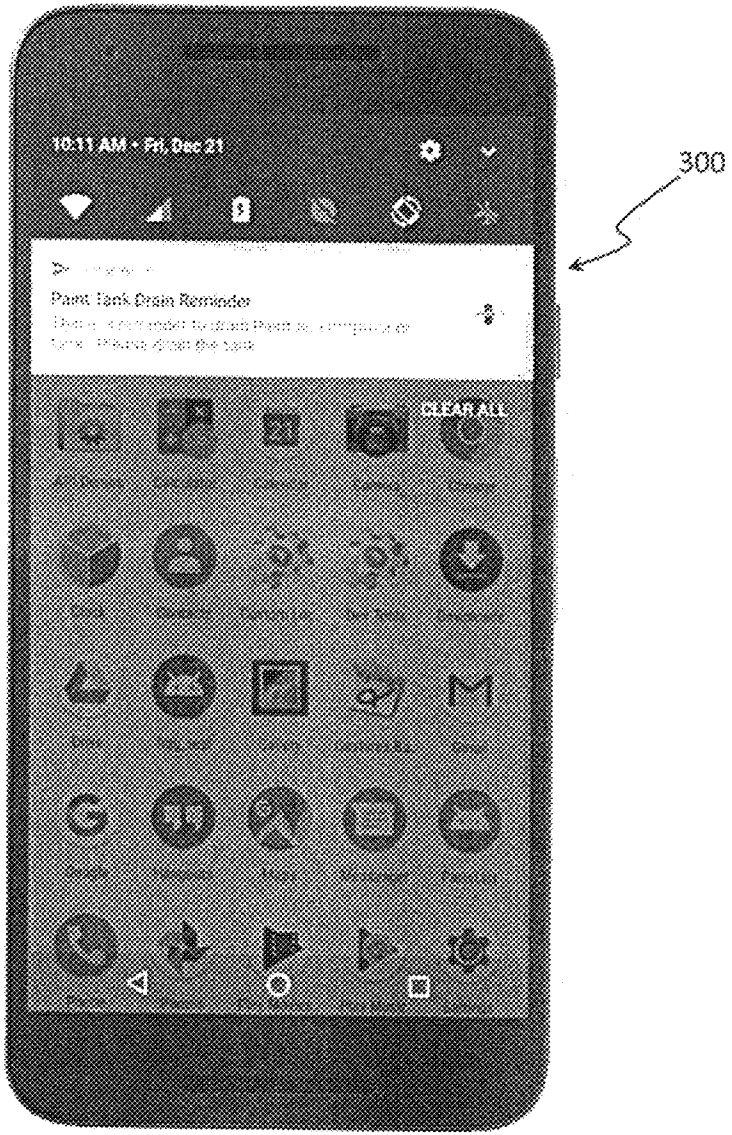
FIG. 16 is a first notification on the display of the present application on the mobile communication device.

FIG. 16 shows an example notification alert 300 (e.g., a popup) for a tank drain, which is delivered as an operating system level alert. Such notifications preferably can be controlled by the user's settings on the mobile communication device 24. Example notifications preferably are run hour based and time based, and can be based on calendar time and on hours of run time for the compressor. A tank drain reminder notification can be sent to the user for each compressor, for instance, at a time specified by the user in the settings for that compressor. The user preferably has the option of turning this notification on or off for the particular compressor within the settings for that compressor. Once set for repeating in an example embodiment, the notification can go off at that time every day or other selected period. Preferably, the user can "snooze" displayed notification alerts for a period of time so the user can be reminded later.

For illustration, consider the following example, in which numbers are provided merely for ease of explanation: Compressor A is set to have its pump oil changed at 200 hrs. or 6 months, whichever comes first. The following example events then occur:

- Notification triggers at 6 months when machine has 145 hours on it
- User changes oil after snoozing a few times and hours are now at 152
- New triggers preferably are set for 152+<oil change interval hrs>200=352 and in another <oil change interval calendar time> 6 months, whichever comes first when the user "Resets" the notification.
- The log preferably includes a note that the maintenance was done on the date and the number of hours that the compressor had on it.

Figure 17:
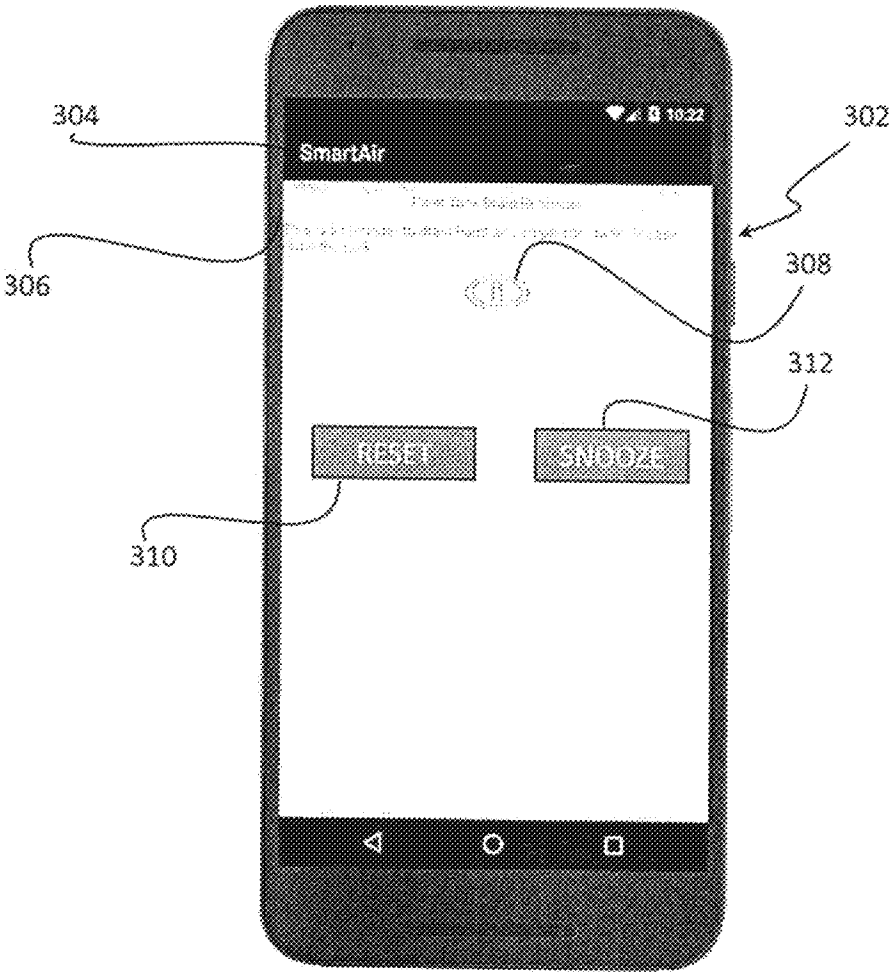
FIG. 17 is a second notification on the display of the present application on the mobile communication device.

FIG. 17 shows an example notification page 302, which preferably may be launched upon user interaction with the notification alert 300 (FIG. 16) (e.g., selecting via clicking, using a personal assistant such as Alexa or Siri, etc.) or alternatively or additionally navigated to via the mobile app 40. The notification page 302 preferably displays the name of the compressor 304, for instance a name that was given in the mobile app settings, and appropriate descriptive text 306 for conveying the particular notification. An icon or other link 308 for a linked frequently asked questions (FAQ) page can be provided for each item to help about that notification. A "Reset" icon or other tool 310 allows the user to "reset" the time period for a maintenance item by, for instance, logging the item in the log such as disclosed above and/or changing the intervals to schedule the next alert. A "Snooze" icon or other tool 312 allows the user to delay and repeat (snooze) the alert and be reminded again after a chosen interval, and preferably allows the user to set a snooze interval at that time (or alternatively, this length is preset via the mobile app or other settings).

Thus, the example system, including a vibration sensor device 22 and connected mobile communication device 24 running a mobile app 40 allows a user to easily and reliably monitor required or suggested maintenance for a compressor User alerts, data collection, data processing, and user assistance can be performed using the example mobile app 40.

A person of ordinary skill in the art would understand that the example mobile app 40 may be implemented in the mobile communication device 24 by one or more modules described herein as well any other additional modules such that a person of ordinary skill in the art may refer to such embodiments as an application platform. Further, the modules and functions thereof may be combined or separated. In addition, such modules can be separated and portions thereof may be implemented across many devices or combined into one device.

Each of the communication interfaces may be software or hardware associated in communicating to other devices. The communication interfaces may be of different types that include a user interface, USB, Ethernet, Wi-Fi, wireless, optical, cellular, or any other communication interface coupled to a communication network.

Persons of ordinary skill in the art will understand that embodiments of example methods may include a subset of the steps shown and described in the figures as well as the order of the steps may be rearranged. Further, additional steps may be implemented by the method before, after, and in between the steps shown and described in the figures. In addition, the steps of example methods may be implemented by one or more modules executed by one or more computing devices as described herein.

In addition, the mobile communication device(s) 24 preferably also has/have one or more communication interfaces. The mobile communication device(s) may include one or more processors 42 that may be co-located with each other or may be located in one module or in different parts of a computing device, or among a plurality of computing devices. The memory 44 may include one or more storage devices that may be co-located with each other or may be located in one module, in different parts of a computing device or among a plurality of computing devices. Types of memory 44 may include, but are not limited to, electronic memory, optical memory, and removable storage media. An intra-device communication link between processor(s), memory device(s), modules, antennas, and communication interfaces may be one of several types that include a bus or other communication mechanism.

The modules disclosed herein may be implemented by the one or more processors 34, 42. Further, the modules and functions thereof may be combined or separated. In addition, such modules can be separated and portions thereof may be implemented across many devices or combined into one device.

Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein. Also, in the foregoing description, numerous details are set forth to further describe and explain one or more embodiments. These details include system configurations, block module diagrams, flowcharts (including transaction diagrams), and accompanying written description. While these details are helpful to explain one or more embodiments of the disclosure, those skilled in the art will understand that these specific details are not required in order to practice the embodiments.

As will be appreciated by one skilled in the art, aspects of the present disclosure may be embodied as an apparatus that incorporates some software components. Accordingly, some embodiments of the present disclosure, or portions thereof, may combine one or more hardware components such as microprocessors, microcontrollers, or digital sequential logic, etc., such as a processor, or processors, with one or more software components (e.g., program code, firmware, resident software, micro-code, etc.) stored in a tangible computer-readable memory device such as a tangible computer memory device, that in combination form a specifically configured apparatus that performs the functions as described herein. These combinations that form specially-programmed devices may be generally referred to herein as modules. The software component portions of the modules may be written in any computer language and may be a portion of a monolithic code base, or may be developed in more discrete code portions such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

While a particular embodiment of the present compressor maintenance monitoring and alert system has been described herein, it will be appreciated by those skilled in the art that changes and modifications may be made thereto without departing from the invention in its broader aspects and as set forth in the following claims.

The invention claimed is:

1. A combined compressor and compressor maintenance monitoring and alert system, comprising:

a compressor;

a sensor unit including a housing, said housing at least partially enclosing at least one vibration sensor and a computer processor, the computer processor having a vibration sensor module configured for processing vibration signals generated from said at least one vibration sensor, a compressor data storage module in said sensor unit configured for storing data representing working time of said compressor, and a transmitter module configured for transmitting said data, said housing being constructed and arranged to have at least one outer surface configured for being releasably mounted to said compressor with means for fastening the outer surface of the housing in contacting a relationship with the compressor for receiving vibrations transmitted from said compressor through said outer surface of said housing via said contacting relationship;

a mobile communications device comprising:

a mobile communication device processor;

executable instructions stored on a non-transitory medium that when executed by the mobile communication device processor, cause the mobile communication device processor to:

receive the compressor data transmitted by said transmitter module of said sensor over a period of time;

process the received compressor data, including making a comparison of the compressor data with stored look up tables of compressor maintenance schedules;

wherein said look up tables comprise maintenance schedules for known compressor models;

determine if the received compressor data indicates that a maintenance task included in the look up tables is required; and display the required maintenance task on a display of the mobile communication device.

2. The combination of claim 1, wherein said transmitter module is configured for either periodically or on demand transmitting said compressor data to the mobile communication device processor.

3. The combination of claim 1, wherein said displaying of the required maintenance tasks on the mobile communications device includes at least one of visual and audible alerts.

* * * * *